US005470263A

United States Patent [19]

Griffiths et al.

[11] Patent Number: 5,470,263

[45] Date of Patent: Nov. 28, 1995

[54] METHOD AND APPARATUS FOR IMPROVING REVERSE THRUST OF A MARINE DRIVE

[75] Inventors: John M. Griffiths, Fond du Lac, Wis.; David A. Gussert, Englewood, Fla.; Michael A. Karls, Hilbert, Wis.

[73] Assignee: Brunswick Corporation, Lake Forest, Ill.

[21] Appl. No.: 234,397

[22] Filed: Apr. 28, 1994

[51] Int. Cl.[6] ..... B63H 21/28

[52] U.S. Cl. ..... 440/75; 440/89

[58] Field of Search ..... 440/89, 75; 416/93 A

[56] References Cited

U.S. PATENT DOCUMENTS

| | | | |
|---|---|---|---|
| 2,948,252 | 8/1960 | Alexander, Jr. . | |
| 3,467,051 | 9/1969 | Shimanckas . | |
| 3,554,665 | 1/1971 | Lorenz et al. . | |
| 3,556,041 | 1/1971 | Shimanckas . | |
| 3,563,670 | 2/1971 | Knuth | 416/93 A |
| 3,754,837 | 8/1973 | Shimanckas . | |
| 3,865,509 | 2/1975 | Frazzell et al. . | |
| 3,871,324 | 3/1975 | Synder . | |
| 4,023,353 | 5/1977 | Hall . | |
| 4,276,036 | 6/1981 | Nishida et al. . | |
| 4,306,867 | 12/1981 | Finze | 416/93 A |
| 4,373,922 | 2/1983 | Weed | 440/89 |
| 4,388,070 | 6/1983 | Kasschau . | |
| 4,436,514 | 3/1984 | Takahashi et al. . | |
| 4,511,339 | 4/1985 | Kasschau . | |
| 4,778,419 | 10/1988 | Bolle et al. . | |
| 5,022,875 | 6/1991 | Karls . | |

*Primary Examiner*—Jesus D. Sotelo

*Attorney, Agent, or Firm*—Andrus, Sceales, Starke & Sawall

[57] ABSTRACT

A marine drive has a reverse thrust cup on the propeller shaft between the propeller hub and the rear retaining nut. The reverse thrust cup permits the propeller hub to slide on the propeller shaft fore and aft. When the marine drive is in the forward direction the rearward thrust of the propeller forces the propeller hub to the forward position thereby directing engine exhaust out the rear of the propeller hub. Conversely, when the marine drive is in the reverse direction, the forward thrust created by the propeller hub forces the propeller hub to the rearward position thereby directing exhaust out a forward exhaust opening forward of the propeller blades increasing the reverse thrust of the marine drive.

23 Claims, 2 Drawing Sheets

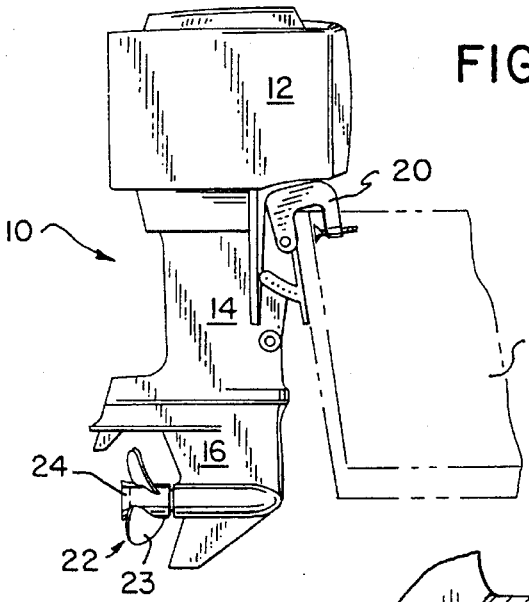
FIG. 1
FIG. 2
PRIOR ART
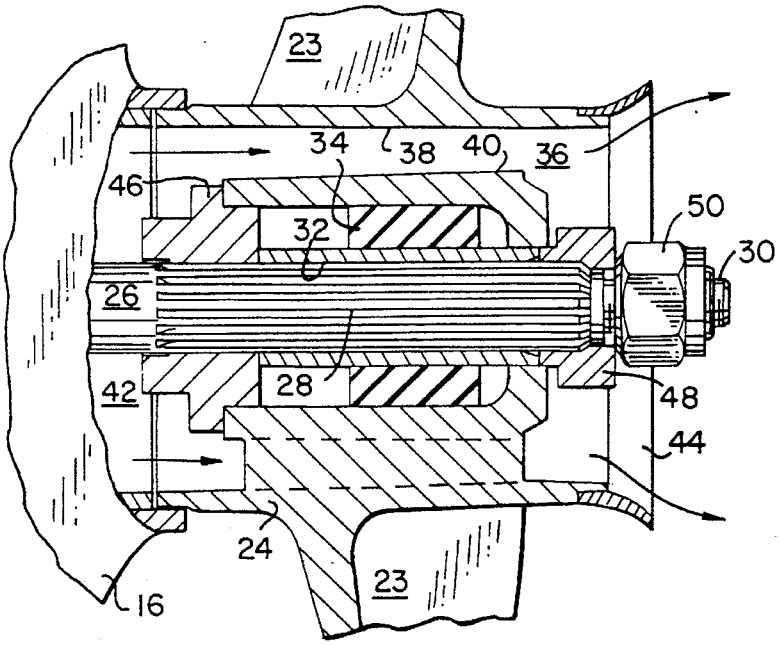
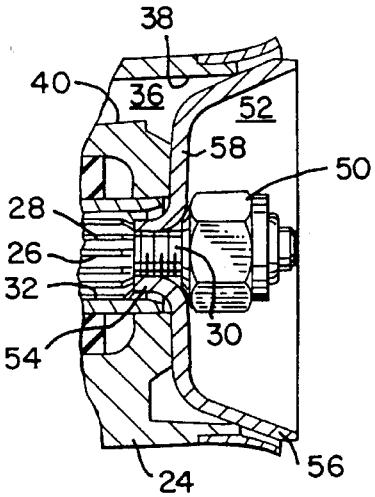
FIG. 3

FIG. 4
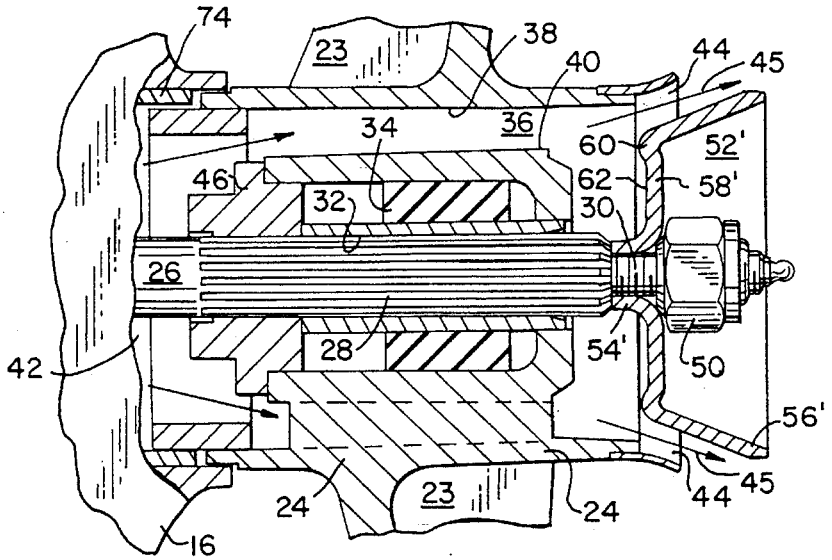
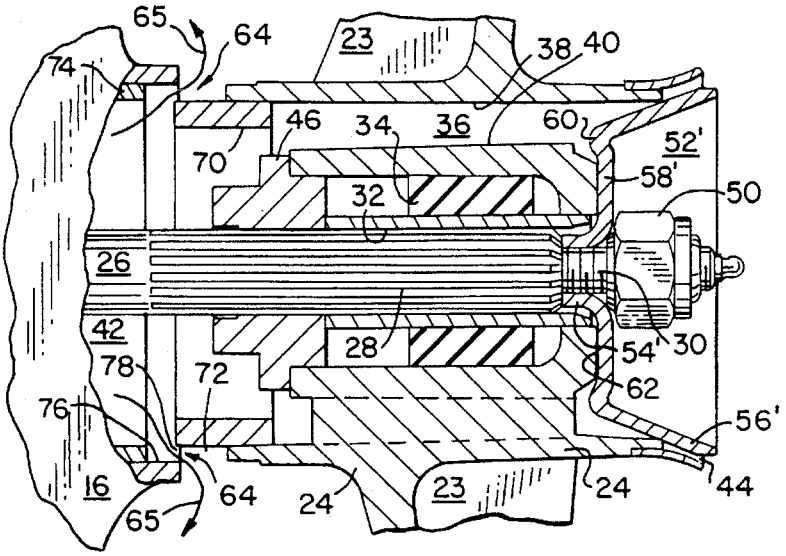
FIG. 5
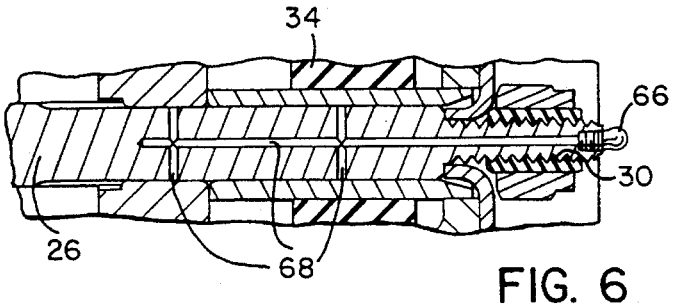
FIG. 6

METHOD AND APPARATUS FOR IMPROVING REVERSE THRUST OF A MARINE DRIVE

BACKGROUND OF THE INVENTION

The invention relates to marine drives, and more particularly to a method and apparatus to improve the reverse thrust in a reversible marine drive.

It is common for marine drives to be equipped with "through-hub" exhaust passages to provide an underwater exhaust passage which not only muffles the engine exhaust noise, but also directs the engine exhaust away from the propeller preventing disturbance of the solid flow of water into the propeller when in the forward direction. However, when in the reverse direction, the rearward discharging engine exhaust is directed back into the blades of the propeller as the propeller hub and marine drive move rearward. This action creates excessive turbulence of the water flow into the propeller which reduces the efficiency, the effectiveness, and the reverse thrust of the propeller and increases cavitation, ventilation and erosion of the propeller blades.

Reduced reverse thrust has been a long standing problem in the industry and several attempts have been made to increase the reverse thrust but have either created increased exhaust noise, been uneconomical to produce, been ineffective, or not been adaptable to retrofitting existing marine drives.

One solution to this problem, generally used in sailboat drives, is to provide a secondary exhaust passage above the propeller hub to discharge exhaust in the reverse direction away from the propeller. However, this creates excessive noise because of the proximity of the passage to the water surface and is not readily adaptable to existing marine drives.

Several prior art patents use specially manufactured propeller hubs and components, such as spring biasing and mechanized shifting devices, to slide the propeller hub fore and aft providing a second exhaust passage forward of the propeller. Examples include U.S. Pat. No. 3,871,324 issued Mar. 18, 1975 to Snyder, U.S. Pat. No. 3,754,837 issued Aug. 28, 1973 to Shimanckas, U.S. Pat. No. 3,556,041 issued Jan. 19, 1971 to Shimanckas, and U.S. Pat. No. 3,467,051 issued Sep. 16, 1969 to Shimanckas, none of which are readily and economically adaptable for retrofitting existing marine drives and none of which use unmodified existing propeller hubs.

Another attempt was made by U.S. Pat. No. 4,023,353 issued May 17, 1977 to Hall, which uses an automatically actuated butterfly valve to change the direction of the exhaust flow depending upon the direction of the marine drive, again, not readily adaptable to existing marine drives and requiring a specially manufactured hub and components.

Other examples not having a slidable propeller hub, but yet attempting to increase reverse thrust, include U.S. Pat. No. 4,778,419 issued Oct. 18, 1988 to Bolle, et al. which provides an opening forward of the propeller hub and uses the water entering the rear of the propeller hub to force exhaust out the forward opening. Others have used similar techniques and/or incorporated outer shrouds, or the like, including U.S. Pat. No. 4,511,339 issued Apr. 16, 1985 to Kasschau, U.S. Pat. No. 4,436,514 issued Mar. 13, 1984 to Takahashi et al, U.S. Pat. No. 4,388,070 issued Jun. 14, 1983 to Kasschau, U.S. Pat. No. 4,276,036 issued Jun. 30, 1981 to Nishida et al. These devices do not have slidable propeller hubs, nor do they block rear discharge, but rely upon a sufficient amount of water flow into the rear passage to prevent exhaust discharge therethrough. The success of these devices therefore is at least partially dependent upon reverse speed. However, several of the applications requiring increased reverse thrust typically operate at slower speeds in the reverse direction. For example, it is desirable in fishing and sailing boats to move rearward slowly, yet it is desirable to produce increased reverse thrust which allows the engine to operate at lower speeds. It is also desirable for the same boats to operate at high reverse speeds in which increased reverse thrust would also be beneficial.

SUMMARY OF THE INVENTION

The present invention includes a method and apparatus for increasing reverse thrust of a marine drive and overcomes the disadvantages of the prior art devices with the use of a reverse thrust cup in place of the rear thrust washer and reusing all other existing components of an existing marine drive. The reverse thrust cup allows the propeller hub to slide fore and aft on the propeller shaft allowing exhaust to discharge out the rear of the propeller hub and behind the propeller blades while the marine drive is in the forward direction, and out a discharge opening forward of the propeller blades while the marine drive is in the reverse position preventing the disturbance of water into the propeller.

The sliding action of the propeller hub on the propeller shaft is accomplished by the thrust created by the propeller blades which propel the marine drive through water. In other words, as the propeller hub and blades propel the marine drive and the boat in the forward direction, the thrust created by the propeller blades forces the propeller hub to the forward position which opens the rear underwater exhaust discharge opening. Conversely, as the propeller hub and blades propel the motor in the reverse direction, the propeller hub is forced rearward against the reverse thrust cup which blocks rearward exhaust flow and opens a forward underwater discharge opening allowing the exhaust to discharge forward and away from the propeller blades.

The reverse thrust cup has at least first and second diameter portions wherein the first diameter portion is forward of the second diameter portion and has a diameter less than the inside diameter of the propeller hub which allows the propeller hub to slide rearward over the first diameter portion of the reverse thrust cup. The second diameter portion of the reverse thrust cup is rearward of the rear exhaust passage in the propeller hub and has a diameter larger than the through-hub exhaust passage such that when the propeller hub is forced rearward by the thrust created when the marine drive is in the reverse direction, the second diameter portion of the reverse thrust cup closes off the rear underwater exhaust discharge opening of the propeller hub. While in this rearward position, a forward underwater discharge opening is created between the propeller hub and the lower gearcase thereby allowing exhaust to discharge forward and away from the propeller blades.

The present invention also includes a method of retrofitting a reversible marine drive to increase reverse thrust, wherein the marine drive has a lower gearcase, a gearcase exhaust passage, and a propeller shaft extending rearwardly from the gearcase and having a threaded rear end. A propeller hub is drivingly mounted to the propeller shaft and has a through-hub exhaust passage communicating the gearcase exhaust passage and a rear underwater discharge opening rearward of the propeller hub and blades. The propeller hub is disposed between forward and rear thrust washers and a retaining nut engages the threaded rear end of the propeller shaft behind the rear thrust washer thereby restricting the fore and aft movement of the propeller hub with respect to the propeller shaft. The method of increasing reverse thrust of the present invention comprises the step of replacing the retaining nut with the above mentioned reverse thrust cup which allows the propeller hub to slide fore and aft on the propeller shaft from a forward position allowing exhaust to discharge out the rear underwater exhaust discharge opening when the marine drive operates in the forward direction to a rearward position allowing exhaust to discharge out a forward underwater exhaust discharge opening when the marine drive operates in a reverse direction.

The present invention also includes a retrofit kit for increasing reverse thrust in a marine drive as described above which includes a reverse thrust cup to replace the rear thrust washer. The retrofit kit may also include a guard ring which may be adapted to encircle a forward portion of the propeller hub to prevent weeds from winding around the propeller shaft while the propeller hub is in the rearward position. Modification may also be made to the propeller shaft to provide external access to lubricate the splines of the propeller shaft and the propeller hub without disassembly.

Additional benefits and advantages of the present invention will become apparent from the subsequent detailed description of the preferred embodiment, the drawings, and the claims.

BRIEF DESCRIPTION OF THE DRAWINGS

FIG. 1 shows a marine drive mounted on a boat.

FIG. 2 shows a cross-sectional view of a portion of the structure of FIG. 1 in assembled condition.

FIG. 3 shows a cross-sectional view of a portion of the structure of FIG. 1 in assembled condition in accordance with the present invention.

FIG. 4 is a cross-sectional view of a portion of the structure of FIG. 1 in accordance with the invention with the propeller hub in a forward position.

FIG. 5 is a view like FIG. 4 and shows the propeller hub in the rearward position.

FIG. 6 is a cross-sectional view of a portion of the structure of FIG. 1 showing a further embodiment of the invention.

DETAILED DESCRIPTION OF THE PREFERRED EMBODIMENT

FIG. 1 shows a marine drive 10 having a power head 12, a mid-section 14, and a lower gearcase 16. The marine drive 10 is typically mounted to a boat 18 by a transom mounting bracket 20 and includes a reversible propeller 22 having blades 23 and a propeller hub 24 extending rearward from lower gearcase 16 to propel the boat through water in both the forward and reverse directions.

Lower gearcase 16 has a rearwardly extending propeller shaft 26, FIGS. 2–5, having a splined portion 28 and a threaded end 30. Propeller hub 24 has a splined first inner diameter portion 32 drivingly engaging splined portion 28 of propeller shaft 26. Typically, propeller hub 24 includes a shock absorbing drive sleeve 34, for example as shown in U.S. Pat. No. 5,022,875. Propeller hub 24 has a through-hub exhaust passage 36 defined by a second inner diameter portion 38 of hub 24 which is radially outward of splined first inner diameter portion 32, and a first outer diameter portion 40 of hub 24 located between the splined first inner diameter portion 32 and the second inner diameter portion 38. Engine exhaust is discharged from power head 12 through mid-section 14 and lower gearcase 16. A lower gearcase exhaust passage 42 communicates engine exhaust to the through-hub exhaust passage 36 and discharges exhaust out a rear underwater exhaust discharge opening 44 rearward of propeller blades 23, FIG. 2. Propeller hub 24 is mounted to propeller shaft 26 between front thrust washer 46 and rear thrust washer 48. A retaining nut 50 threadingly engages the threaded end 30 of propeller shaft 26 rearward of rear thrust washer 48 such that propeller hub 24 has limited fore and aft movement with respect to propeller shaft 26. Such through-hub exhaust propeller hubs are well known in the prior art, for example, U.S. Pat. Nos. 3,865,509 and 2,948,252 describe such a hub.

To increase reverse thrust, a reverse thrust cup 52, 52' FIGS. 3–5, replaces the rear thrust washer 48 of FIG. 2. Reverse thrust cup 52, 52', FIGS. 3–5, includes first diameter portion 54, 54' forward of a second diameter portion 56, 56'. The first diameter portion 54, 54' of reverse thrust cup 52, 52' has a diameter less than that of the splined first inner diameter portion 32 of hub 24. This allows hub 24 to slide to a rearward position as shown in FIGS. 3 and 5 as opposed to the forward position shown in FIG. 4. Second diameter portion 56, 56' is rearward of the second inner diameter portion 38 of hub 24 and has a diameter which is greater than that of second inner diameter portion 38 of propeller hub 24. The second diameter portion 56, 56' of the reverse thrust cup 52, 52' blocks the through-hub exhaust passage 36 when propeller hub 24 is in the rearward position as shown in FIGS. 3 and 5. Reverse thrust cup 52, 52', FIGS. 3 and 5, has a transition portion 58, 58' which is substantially perpendicular to the first diameter portion 54, 54' of reverse thrust cup 52, 52'. Transition portion 58, 58' provides a stop for the sliding propeller hub 24 when the propeller hub slides to the rearward position as shown in FIGS. 3 and 5. The transition portion may include a raised portion 60, FIGS. 4–5, which creates a damping indentation 62 in the reverse thrust cup 52'. The raised portion 60 allows a portion of water to occupy the damping indentation 62 such that rearward sliding movement of propeller hub 24 is damped prior to stopping against transition portion 58' of reverse thrust cup 52'.

In operation, as propeller hub 24 turns in the forward direction propelling the boat forward, the slidable propeller hub 24, FIG. 4, is also forced forward by the thrust created by the rotating propeller blades 23, FIG. 1. While in the forward direction, FIG. 4, engine exhaust is directed from lower gearcase exhaust passage 42, through through-hub exhaust passage 36, and discharged out rear underwater exhaust discharge opening 44 as shown by direction arrows 45 in FIG. 4. However, when the marine drive is selected to drive in the reverse direction, propeller hub 24 rotates in an opposite direction propelling the boat in the reverse direction. The reverse thrust forces propeller hub 24 rearward as shown in FIG. 5 until it is stopped at transition portion 58' of reverse thrust cup 52'. When propeller hub 24 is in the rearward position, as shown in FIG. 5, a forward underwater exhaust discharge opening 64 is created wherein exhaust is discharged from lower gearcase exhaust passage 42 out forward underwater discharge opening 64 forward of propeller blades 23. In this manner, as the marine drive moves in the reverse direction, exhaust is discharged forward of the blades, as shown by the direction arrows 65 in FIG. 5, thereby avoiding contact with the blades which reduces turbulence and cavitation of the propeller blades.

The reverse thrust cup is readily adaptable and is intended as a retrofit to existing marine drives. The retrofit can easily be accomplished by the owner of the marine drive by removing retaining nut 50, FIG. 2, and removing and discarding rear thrust washer 48. The owner would then simply slide the reverse thrust cup 52, 52', FIGS. 3 and 5, over propeller shaft 26, then replace and tighten retaining nut 50. The retrofit procedure would then be complete and the existing marine drive would have improved reverse thrust and reduced cavitation of the propeller.

The method and apparatus of improving reverse thrust is also applicable to new production marine drives. A further modification during production may include machining propeller shaft 26, FIG. 6, to incorporate a lubrication fitting 66 and lubrication passages 68, FIG. 6. Lubricating the splines of the propeller hub and the shaft improves the slidability of the propeller hub on the shaft.

Further, guard ring 70, FIG. 5, may be attached, for example by press-fit, to propeller hub 24 to prevent weeds from winding around the propeller shaft while propeller hub 24 is in the rearward position. Guard ring 70 may be part of a retrofit kit or used in new manufacture of marine drives. Propeller hub 24 is axially slidable along propeller shaft 26 between forward, FIG. 4, and rearward, FIG. 5, positions. Guard ring 70 is mounted to the propeller hub at the forward end thereof and extends forwardly therefrom. The propeller hub in its rearward position is spaced rearwardly of gearcase 16 by an axial gap 72 therebetween. Guard ring 70 extends fore to aft and bridges axial gap 72. Guard ring 70 is telescopically received within gearcase 16 when propeller hub 24 is in its forward position, FIG. 4, wherein guard ring 70 slides along and is closely adjacent gearcase liner 74 to close off the forward discharge opening 64. Guard ring 70 is spaced radially inwardly of gearcase bore 76 by a radial gap 78. Guard ring 70 is at least partially withdrawn from gearcase bore 76 when propeller hub 24 is in its rearward position such that exhaust flows as shown at arrows 65 from the gearcase rearwardly through radial gap 78 and then outwardly through axial gap 72 externally of guard ring 70 and forwardly of propeller hub 24.

It is recognized that various equivalents, alternatives, and modifications are possible within the scope of the appended claims.

We claim:

1. A method of retrofitting a reversible marine drive to increase reverse thrust, the marine drive having a lower gearcase, a gearcase exhaust passage, a propeller shaft extending rearwardly from the gearcase and having a threaded rear end, a propeller hub drivingly mounted to the propeller shaft and having a first inner diameter portion in contact with the propeller shaft and a second inner diameter portion radially outward of the first inner diameter portion and a first outer diameter portion between the first and second inner diameter portions wherein the first outer diameter portion and the second inner diameter portion define a through-hub exhaust passage communicating with the gearcase exhaust passage and a rear underwater exhaust discharge opening being generally rearward in the propeller hub, a retaining nut threadedly engaging the threaded rear end of the propeller shaft, and a rear thrust washer disposed between the propeller hub and the retaining nut such that the propeller hub has limited fore and aft movement with respect to the propeller shaft, the method comprising replacing the rear thrust washer with a reverse thrust cup, the reverse thrust cup having at least first and second diameter portions, the first diameter portion being forward of the second diameter portion and having a diameter less than that of the first inner diameter portion of the propeller hub, and the second diameter portion being rearward of the second inner diameter portion of the propeller hub and having a diameter greater than that of the second inner diameter portion of the propeller hub, and wherein the propeller hub is allowed to slide on the propeller shaft from a forward position allowing exhaust to discharge out the rear underwater exhaust discharge opening to a rearward position allowing exhaust to discharge out a forward underwater exhaust discharge opening.

2. The method of claim 1 wherein the propeller hub is in the forward position when the marine drive operates in a forward direction and in the rearward position when the marine drive operates in a reverse direction.

3. The method of claim 1 wherein the sliding action of the propeller hub is a result of the thrust produced by the propeller hub.

4. A marine drive having a reversible propeller to selectively drive a boat in the forward and reverse directions and having increased reverse thrust in the reverse direction, comprising:

a lower gearcase having an exhaust passage;

a propeller shaft extending rearwardly from the lower gearcase and having a threaded rear end;

a propeller hub drivingly engaging the propeller shaft and having a first inner diameter portion engaging the propeller shaft and a second inner diameter portion radially outward of the first inner diameter portion and a first outer diameter portion between the first and second inner diameter portions and a through-hub exhaust passage between the first outer diameter portion and the second inner diameter portion, the through-hub exhaust passage communicating with the lower gearcase exhaust passage and a rear exhaust discharge opening being generally rearward in the propeller hub;

a retaining nut threadedly engaging the threaded rear end of the propeller shaft; and a reverse thrust cup disposed between the propeller hub and the retaining nut on the propeller shaft, the reverse thrust cup having a first and second diameter portions, the first diameter portion being forward of the second diameter portion and having a diameter less than that of the first inner diameter portion of the propeller hub, and the second diameter portion being rearward of the second inner diameter portion of the propeller hub and having a diameter greater than that of the second inner diameter portion of the propeller hub.

5. The invention according to claim 4 wherein the propeller hub is slidably mounted to the propeller shaft.

6. The invention according to claim 5 wherein the cup further comprises a transition portion connecting said first and second diameter portions and providing a stop for the sliding propeller hub.

7. The invention according to claim 6 wherein the reverse thrust cup further comprises a damping indentation in the transition portion allowing a portion of water to occupy the indentation and damping rearward sliding movement of the propeller hub.

8. The invention according to claim 5 wherein the propeller hub slides on the propeller shaft in response to the thrust of the propeller hub.

9. The invention of claim 8 wherein the propeller hub is slid forward when the marine drive is selectively driven in the forward direction and slid rearward when the marine drive is selectively driven in the reverse direction.

10. The invention of claim 9 further comprising a power head which produces exhaust, wherein the exhaust is discharged through the lower gearcase and rearward of the propeller hub when the marine drive is selectively driven in the forward direction and discharged forward of the propeller hub when the marine drive is selectively driven in the reverse direction.

11. The invention of claim 5 further comprising a means to lubricate the slidably mounted propeller hub.

12. The invention of claim 4 further comprising a guard ring attached to the propeller hub to protect the propeller shaft.

13. The invention of claim 12 wherein said propeller hub is axially slidable along said propeller shaft between forward and rearward positions, and said guard ring is mounted to said propeller hub at the forward end thereof and extends forwardly therefrom.

14. The invention of claim 13 wherein said propeller hub in said rearward position is spaced rearwardly of said gear case by an axial gap therebetween, and wherein said guard ring extends fore to aft and bridges said axial gap.

15. The invention of claim 14 wherein said guard ring is telescopically received within said gearcase when said propeller hub is in said forward position.

16. The invention of claim 15 wherein said guard ring is spaced radially inwardly of said gearcase by a radial gap and wherein said guard ring is at least partially withdrawn from said gearcase when said propeller hub is in said rearward position such that exhaust flows from said gearcase rearwardly through said radial gap and then outwardly through said axial gap externally of said guard ring and forwardly of said propeller hub.

17. A retrofit kit for increasing reverse thrust in a marine drive having a lower gearcase, a gearcase exhaust passage, a propeller shaft extending rearwardly from the gearcase and having a threaded rear end, a propeller hub drivingly mounted to the propeller shaft and having a first inner diameter portion in contact with the propeller shaft and a second inner diameter portion radially outward of the first inner diameter portion and a first outer diameter portion between the first and second inner diameter portions wherein the first outer diameter portion and the second inner diameter portion define a through-hub exhaust passage communicating with the gearcase exhaust passage and a rear underwater exhaust discharge opening which is generally rearward in the propeller hub, a retaining nut threadedly engaging the threaded rear end of the propeller shaft, and a rear thrust washer disposed between the propeller hub and the retaining nut, the retrofit kit comprising a reverse thrust cup replacing the rear thrust washer disposed between the propeller hub and the retaining nut on the propeller shaft, the reverse thrust cup having at least first and second diameter portions, the first diameter portion being forward of the second diameter portion and having a diameter less than that of the first inner diameter portion of the propeller hub, and the second diameter portion being rearward of the second inner diameter portion of the propeller hub and having an increasing diameter rearward wherein a rearward portion of the reverse thrust cup has a diameter greater than that of the second inner diameter portion of the propeller hub.

18. The invention according to claim 17 wherein the propeller hub is slidably mounted to the propeller shaft.

19. The invention according to claim 18 wherein the cup further comprises a transition portion connecting said first and second diameter portions and providing a stop for the sliding propeller hub.

20. The invention according to claim 19 wherein the reverse thrust cup further comprises a damping indentation in the transition portion allowing a portion of water to occupy the indentation and damping the rearward sliding movement of the propeller hub.

21. The invention according to claim 18 wherein the propeller hub slides on the propeller shaft in response to the thrust of the propeller hub.

22. The invention of claim 21 wherein the propeller hub is slid forward when the marine drive is selectively driven in the forward direction and slid rearward when the marine drive is selectively driven in the reverse direction.

23. The invention of claim 22 further comprising a power head which produces exhaust, wherein the exhaust is discharged through the lower gearcase and rearward of the propeller hub when the marine drive is selectively driven in the forward direction and discharged forward of the propeller hub when the marine drive is selectively driven in the reverse direction.

* * * * *